United States Patent [19]

Schiemann

[11] 4,399,850

[45] Aug. 23, 1983

[54] BRACE FOR PLASTIC CANISTERS

[76] Inventor: Wolfram Schiemann, Hohenzollernplatzl, 7140 Ludwigsburg, Fed. Rep. of Germany

[21] Appl. No.: 231,600

[22] Filed: Feb. 5, 1981

[30] Foreign Application Priority Data

Dec. 27, 1980 [DE] Fed. Rep. of Germany ..... 3049232

[51] Int. Cl.[3] ..... B65D 25/02

[52] U.S. Cl. ..... 150/0.5; 150/2.7; 220/71

[58] Field of Search ..... 150/0.5, 2.7, 31; 220/71

[56] References Cited

U.S. PATENT DOCUMENTS

| | | | |
|---|---|---|---|
| 684,701 | 10/1901 | Meinecke | 150/2.7 |
| 1,172,197 | 2/1916 | Cook | 150/2.7 |
| 1,716,947 | 6/1929 | Boardman | 220/71 |
| 2,024,908 | 12/1935 | Blum | 150/2.7 |
| 2,672,902 | 3/1954 | Prager | 150/0.5 |

*Primary Examiner*—Donald F. Norton

[57] ABSTRACT

A brace for connecting the larger side walls of plastic containers is formed as a separate element of construction inside the canister. The brace has two anchor plates which are joined to the inner surfaces of the canister walls and a collapsible pull brace portion which extends from and between the inner surfaces of the anchor plates. The pull brace portion partially collapses when the side walls move inward and stretches, under tension, to the length between the inner surfaces of the anchor plates.

14 Claims, 5 Drawing Figures

BRACE FOR PLASTIC CANISTERS

The invention relates to a brace for connecting the two larger side walls of plastic containers, more particularly of canisters. Such a state of the art has become known, for example, from the U.S. Pat. Nos. 3,334,768; 3,524,488; 3,552,599 or the Brit. Pat. No. 1,007,563. Containers of this kind may be stationary. They are then called "tanks". They may, however, also be portable. In that case they are referred to as "canisters". When these containers are filled with highly volatile liquids such as, for example, gasoline, the problem of diffusion appears. Above any liquid level of this highly volatile substance, a gas is formed which in the course of time diffuses through the plastic.

BACKGROUND OF THE INVENTION

Moreover, the containers bulge—unless they are filled completely with liquid—in balloon-like fashion under the influence of external heat. This also happens in the case of sheet metal canisters, but not to the same extent. The plastic canisters then fit no longer into standard holders or can no longer be taken out of these standard holders. If the containers are fuel tanks in motor vehicles, they do not have to be removed. Nevertheless, the designer must make provisions that the tanks are able to change their shape in the manner required.

In the cast of stationary tanks, for example, in basements or buried in the ground, the changes do not play a major part since it is in this case possible to install vents which, in contrast to the tanks in motor vehicles, never become clogged. Here, however, the hydrostatic pressure on the side walls does play a part.

Another fact which plays a part in the case of 20- and 30-l canisters is that they are, when dropped from a height, briefly deformed into a pear-like shape and that the walls must be capable of following this deformation without force peaks, because otherwise additional forces would act on the walls.

Generally speaking, plastic canisters would be superior to metal canisters for various reasons because they are, for example, considerably lighter in weight than metal canisters, do not have to be painted, no rust flakes off on the inside as time goes on, they do not rattle, and so on.

However, the efforts to stabilize the side walls have thus far failed to lead to a practical solution.

For example, it has not been possible to produce a practically useful brace according to FIG. 1 of the Brit. Pat. No. 1,007,563, because the deep-drawing ratio is much too large and the walls of the braces are then too thin. This applies not only to the walls of the braces but above all to the angle regions. However, a canister is only as strong as its weakest point. Moreover, such braces represent very troublesome structural elements when it is a question of improving the drop resistance of canisters because they try not to yield either to tension or the compression. Finally, these braces take away a very considerable volume. However, for example, a 20-l canister has a geometry specified by standards within which 20 liters must be accommodated. This cannot be done if part of the volume is sacrificed in other ways.

In the case of the device according to U.S. Pat. No. 3,552,599, an attempt has been made to eliminate the large deep-drawing ratio by realizing the braces by two flat cones. This, however, leads to a large loss of volume, particularly when, for example, in the case of larger containers, four such braces must be provided.

Here again—as in the other state of the art—the brace must be formed of blown plastic material which, because of the limited blowing pressures, is known to be flabby. Although it may do for a canister wall, it performs the bracing function very poorly. For example, at the point 76 in FIG. 5 of this U.S. patent, this material offers practically no resistance to notch cracks.

OBJECT AND STATEMENT OF THE INVENTION

The object of the invention is to specify a brace which without a noticeable sacrifice in volume stabilizes the side walls and permits a practically feasible solution.

According to the invention, this problem is solved by the following features: the brace is formed as a separate element of construction arranged to be set inside the canister. The brace has two brace ends with one anchor plate at each end. The anchor plates each have an inner and outer surface, whose outer surface is arranged to be joined to a partial region of the inner surfaces of the canister situated opposite each other. The brace also has a pull-brace portion which extends from the inner surfaces of the anchor plates, which can be stressed under tension to a stretched state and which in the stretched state has a length equal to the distance between the inner surfaces of the anchor plates. The pull-brace portion is constructed in such a way that it partially collapses when the side walls move inward.

Advantageously, the invention has the following additional features:

The anchor plates and the pull-brace portion are made of one piece. Through this characteristic, additional welding and bonding operations are avoided. In addition, the introduction of the forces can be controlled more easily by providing, for example, sufficiently large radii between the anchor plate and the pull brace.

The anchor plates and the pull-brace portion are injection-molded. Through these characteristics, the anchor plates and the pull braces can be made relatively thin and yet highly stressable.

The anchor plates are made of the same material as the side walls. Through this characteristic, the weldability between the anchor plates and the side walls is facilitated.

The pull-brace portion is a rope. This characteristic represents the simplest form of a brace according to the invention.

The pull-brace portion is a plane wall. Through this characteristic, the sloshing of the liquid in portable containers can be dampened and at the same time a preferred direction can be fixed within which even angular movements of the anchor plates and, therefore, of the side walls are to be reduced.

The pull-brace portion is formed by several walls arranged at angles to each other and these walls are separate from each other along the length of the pull-brace portion. Due to this characteristic, it is possible to fix several such preferred directions, further reduce sloshing, and nevertheless prevent fluid from remaining in the corners of the walls when the canisters are being emptied.

The pull-brace portion has the shape of a foldable garland. Through this characteristic, it becomes possible to fold the pull brace together so tightly that it can even be inserted in the extrusion tube. Only inside the tube is the pull brace then brought to its final length.

The anchor plates are round. This characteristic permits the discontinuities caused by the anchor plates to produce minimal interference. With very angular anchor plates such as, for example, triangular anchor plates, force peaks would emanate from the points of the anchor plates.

The walls of the pull-brace portion consist of at least two partial walls which in the stretched state lie in a common semiplane. This characteristic makes it possible to fabricate the brace more easily by injection-molding, and the components are better able to have an existence of their own than if they were fully interconnected.

The pull-brace portion walls consist of four partial walls, each offset by 90° with respect to the other. Through this characteristic, a design is achieved which is practically the equivalent of a tube with optimal prevention of sloshing.

In the fully collapsed state, the partial walls lie with half a partial wall each on top of each other and their circumference in this state follows the circumference of the anchor plates. These characteristics result in a particularly simple brace which is easy to transport and insert and which has no projecting sections.

DESCRIPTION OF THE DRAWINGS

The invention shall now be explained with the aid of a preferred embodiment. On the drawing.

DETAILED DESCRIPTION

Figure 1:
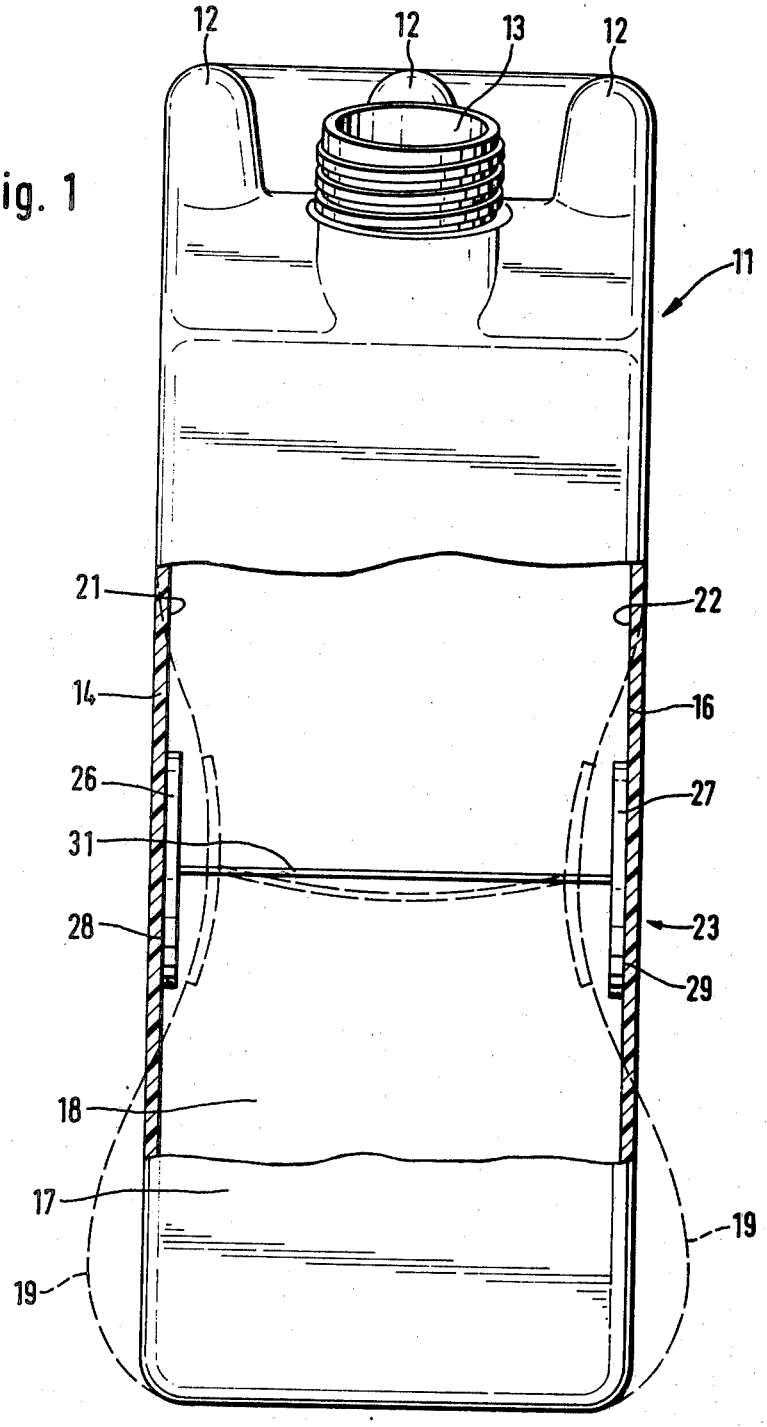
FIG. 1 shows the front view of a 20-l canister, partially cut away, with a brace and with the deformation—shown in exaggerated fashion by a broken line—caused by the impact of the canister when dropped.

A 20-l canister 11 is blown or injection-molded from plastic. It has the usual three handles 12 and a pouring spout 13. Following the usual pattern, its side walls 14,16 are substantially wider than its front wall 17 and its rear wall 18. When there is a pressure inside the canister, there is the danger that the side walls 14,16 bulge toward the outside in a manner not shown. When the canister drops on the floor, a shape results over a short period of time according to the broken lines 19. The upper part which is more rigid because of numerous offsets, the handles 12, the spout 13, etc., is hardly deformed at all and it is mainly the lower part which is deformed.

The side walls 14,16 have inner surfaces 21,22. At a height at which the side walls 14,16 are deflected inward a brace 23 is provided. The brace 23 is situated at that level because it then exerts no additional forces on the side walls 14,16 which would certainly be the case if the brace 23 were provided, for example, in the lower belly of the line 19. The brace 23 is situated at the same time in the approximate region in which the side walls 14,16 would be forced apart when at high temperatures the gas mixture inside the canister 11 exerts a high pressure.

In this first embodiment, the brace 23 has at its two ends plates 26,27 whose outer surfaces 28,29 are welded to the inner surfaces 21,22. In order to facilitate the welding, the outer surfaces 28,29 have small cones (not shown) such as have been described, for example, in the German Pat. No. 2,151,913.

The plates 26,27 are circular. At their center, they change into a rope 31 which is monofil and was injection-molded simultaneously with the plates 26,27.

As shown in FIG. 1, the rope 31 can be stressed only under tension; it gives way when the side walls are pressed together which may by no means happen only when the canister is dropped.

Figure 5:
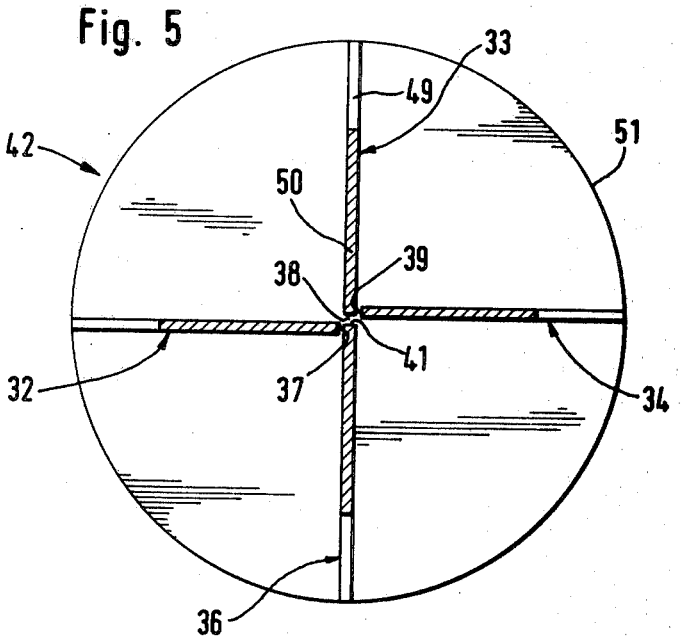
FIG. 5 shows a section along the line 5—5 in FIG. 2.

In the second embodiment according to the following figures, the plates 26,27 are provided. In addition, there is a system of four walls 32,33,34,36 which at their ends are integral with the plates 26,27. As shown particularly clearly in FIG. 5, the inner edges 37,38,39,41 are not cohesive. On the contrary, there is no connection from one wall to the next. The walls 32,33,34,36 can be practically only a few tenths of a millimeter in thickness since they are designed expressly only for tensile stress but not for shear stress such as is also the case with the rope. The inner edges 37 to 41 are disposed in such a manner that this brace 42 can be fabricated with a two-piece tool with two slides. This is accomplished by aligning the walls 33,36 and by transposing the walls 32,34 in their alignment relative to the inner edges 38,41 so that the clearance existing in between can be realized. A clearance exists also between the inner edge 37 and the wall 36 and one between the inner edge 39 and the wall 33. These clearances prevent that during the emptying of the canister the walls retain puddles of liquid, depending on the position of the canister.

For the same reason, each wall 32 to 36 has at the point where it adjoins the plates 26,27 a perforation 43. The plates 26,27 can be brought together from the configuration according to FIG. 2 via a configuration according to FIG. 3 to a distance at which the brace 42 is only a single disk. This provides access even into small recesses. To this end, the wall 32, for example, has along the plate 26 a specified bending line 44 which makes it possible to jackknife the region situated to the right of the specified bending line 44 in the downward direction. In the middle, the wall 32 has a specified bending line 46 which acts in the direction of a V-trough closed in the downward direction. At the transition from the wall 32 to the plate 27 another specified bending line 47 is provided which imparts to the wall region situated to the left of it a tendency to fold out of the way in the upward direction when the plates 26,27 approach each other.

All the other walls 33,34,36 have such specified bending lines and all the specified bending lines of these other walls produce the same tendencies. This then results in a folding scheme which comes into being at a certain approach of the plates 26,27 according to FIG. 3. When the plates 26,27 are brought together to their closest distance, then only the walls are sandwiched between them in a double layer. However, in no case do the individual walls rest in addition against any other walls.

Figure 2:
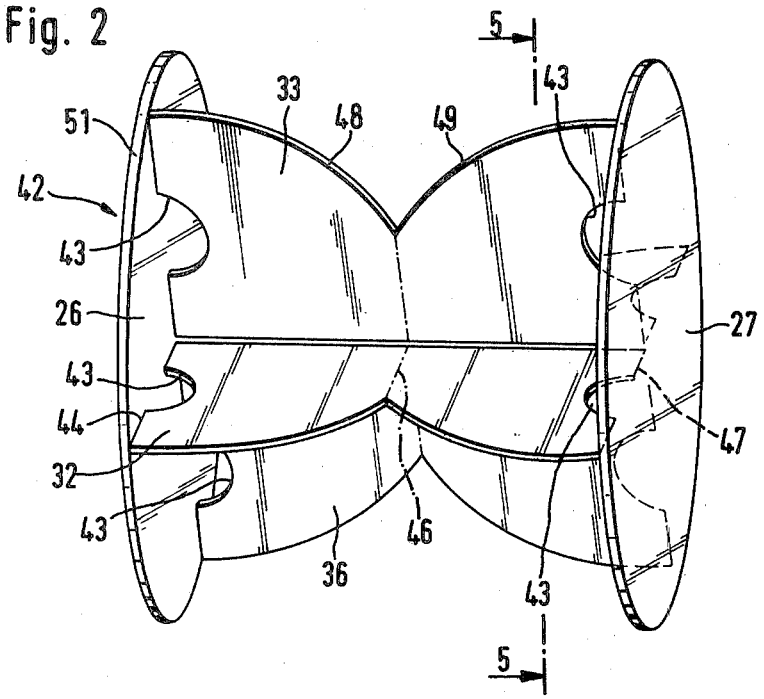
FIG. 2 shows a view of a second brace seen approximately in the direction of FIG. 1, but without the canister associated with it.
Figure 3:
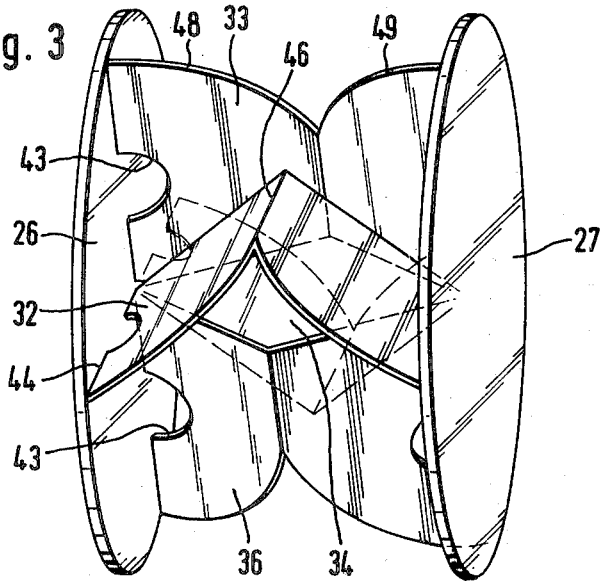
FIG. 3 shows a view similar to FIG. 2, but in a slightly more collapsed state of the brace.
Figure 4:
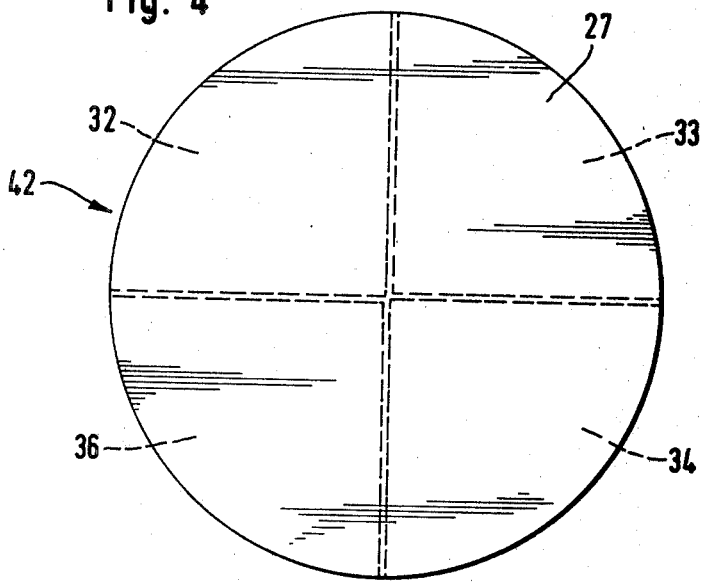
FIG. 4 shows the side view of the brace according to FIGS. 2 and 3 in the fully collapsed state.

If now the outer edges of the walls 32 to 36 were just as rectilinear as the walls of the inner edges 37 to 41, then the outer edges would in the folded state project beyond the plates 26,27. By cutting these protruding edges off, the roughly cosine-like shape of the walls shown particularly in FIG. 2 is formed. The edges 48,49 of the wall 33 run on circular arcs which start in each case outside at the edge of the plate 26 or 27, resp., and then extend toward the middle up to the respective specified bending line. This then leaves a cross section 50 occupying approximately half the height of the wall 33 which represents the weakest point which can be stressed under tension.

Since there is nothing projecting beyond the edges 51 of the plates 26,27, the latter are easy to manipulate.

The arc-like shape of the edges 48,49 with the resulting indentation according to FIG. 2 has the effect that the plates 26,27 are connected with each other by a still more universal joint than if these edges 48,49 would run directly and straight from the edge 51 of the plate 26 to the edge 51 of the plate 27.

I claim:

1. A container made of plastic having two larger side walls and two smaller side walls, in combination with a brace for connecting the two larger side walls of the container, wherein said container comprises a canister for highly volatile liquids, and wherein the brace is formed as a separate element of construction arranged to be set inside the canister, and further comprises two brace ends with one anchor plate at each end, the anchor plates each having an inner and outer surface, whose outer surface is arranged to be joined to a partial region of the inner surfaces of the canister situated opposite each other, said anchor plates being round and made of the same material as said canister side walls, a pull-brace portion extending from the inner surfaces of the anchor plates, which can be stressed under tension to a stretched state and which in the stretched state has a length equal to the distance between the inner surfaces of the anchor plates, the pull-brace portion comprises a plane wall, the pull-brace portion being constructed in such a way that it partially collapses when the side walls move inward.

2. Container according to claim 1, wherein the anchor plates and the pull-brace portion are made of one piece.

3. Container according to claim 1, wherein the anchor plates and the pull-brace portion are injection-molded.

4. Container according to claim 1, wherein the pull-brace portion is formed by several walls arranged at angles to each other and that these walls are separate from each other along the length of the pull-brace portion.

5. Container according to claim 1, wherein the pull-brace portion is a folded sandwich construction comprising wall halves joined together at a v-trough.

6. Container according to claim 1 in which the pull-brace portion consists of at least two walls which in the stretched state lie in a common plane.

7. Container according to claim 6, comprising four walls, each offset by 90° with respect to the other.

8. Container according to claim 6 or 7, wherein the walls comprise foldable wall halves and in the fully collapsed state, one half of each wall lies folded over on the other half and the circumference of the wall halves in this fully collapsed state follows the circumference of the anchor plates.

9. Brace for connecting the two larger side walls of plastic canisters for highly volatile liquids, wherein the brace is formed as a separate element of construction arranged to be set inside the canister, the brace comprising:

two brace ends with one anchor plate at each end, the anchor plates each having an inner and outer surface, whose outer surface is arranged to be joined to a partial region of the inner surfaces of the canister situated opposite each other, said anchor plates being round and made of the same material as said canister side walls, a pull-brace portion extending from the inner surfaces of the anchor plates, which can be stressed under tension to a stretched state and which in the stretched state has a length equal to the distance between the inner surfaces of the anchor plates, the pull-brace portion comprises a plane wall, the pull-brace portion being constructed in such a way that it partially collapses when the side walls move inward.

10. Brace according to claim 9, wherein the pull-brace portion is formed by several walls arranged at angles to each other and that these walls are separate from each other along the length of the pull-brace portion.

11. Brace according to claim 9 wherein the pull-brace portion is a folded sandwich construction comprising wall halves joined together at a v-trough.

12. Brace according to claim 9, in which the pull-brace portion consists of at least two walls which in the stretched state lie in a common plane.

13. Brace according to claim 12, comprising four walls, each offset by 90 degrees with respect to the other.

14. Brace according to claim 12 or 13, wherein the walls comprise foldable wall halves, and in the fully collapsed state, one half of each wall lies folded over on the other half and the circumference of the wall halves in this fully collapsed state follows the circumference of the anchor plates.

* * * * *